US006079348A

United States Patent [19]

Rudolph

[11] Patent Number: 6,079,348

[45] Date of Patent: Jun. 27, 2000

[54] DIVING APPARATUS AND METHOD FOR ITS PRODUCTION

[76] Inventor: Stephan Rudolph, Im Lauchhau 9, D-70569 Stuttgart, Germany

[21] Appl. No.: 09/046,634

[22] Filed: Mar. 24, 1998

[30] Foreign Application Priority Data

Mar. 24, 1997 [DE] Germany ..... 197 12 257

[51] Int. Cl.[7] ..... B63C 11/46

[52] U.S. Cl. ..... 114/315; 440/15

[58] Field of Search ..... 114/315; 440/13–16

[56] References Cited

U.S. PATENT DOCUMENTS

| | | | |
|---|---|---|---|
| 1,324,961 | 12/1919 | Grantham . | |
| 2,337,318 | 12/1943 | Eliuk . | |
| 2,936,729 | 5/1960 | Kuttner | 440/15 |
| 3,160,133 | 12/1964 | Walker . | |
| 3,618,551 | 11/1971 | Deslierres . | |

FOREIGN PATENT DOCUMENTS

| | | |
|---|---|---|
| 2131058-A5 | 10/1972 | France . |
| PS-836603 | 5/1952 | Germany . |
| AS-1033539 | 7/1958 | Germany . |
| 3739887-A | 6/1989 | Germany . |
| 4031336-A | 4/1992 | Germany . |
| 9419339 U1 | 9/1995 | Germany . |
| 801000 | 9/1958 | United Kingdom . |
| 1510722 | 5/1978 | United Kingdom . |

OTHER PUBLICATIONS

Nozomi Kawasetsu, "Shell for Underwater Sailing Body," JP 5–25564(A), Feb. 2, 1993 vol. 17/ No. 309.

Tomoichi Oda, "Submersible Apparatus," JP 60–176892 (A), Sep. 10, 1985, vol. 10/ No. 18.

Akira Nagashima, "Small Submarine Boat," JP 3–276 898 (A), Dec. 9, 1991, vol. 16/ No. 99.

Minoru Nagai, "Fish Fin Underwater Propelling Device," JP 56–86890 (A), Jul. 15, 1981, vol. 5/ No. 162.

Dr. Stephanie L Merry, "Advances in the Design of Energy–Efficient Submersibles," Ship & Boat International, Mar. 1996, pp. 41, 43, & 45.

M.K. Services, "Lightweight, Low–Cost ROV Available Next Month in the U.K. From M.K. Services," Ship & Maritime Management, Jan. 1985, p. 45.

P. Kottik, "Bionics–Shown on the Example of Mobile Hydrospace Systems," mt, No. 2, Apr. 1973, pp. 59–64.

"La Revue Maritime, " Dec. 1956, pp. 1512 & 1513.

*Primary Examiner*—Jesus D. Sotelo

*Attorney, Agent, or Firm*—Birch, Stewart, Kolasch & Birch, LLP

[57] ABSTRACT

A diving apparatus includes an elongated hollow body which can completely accommodate a human body extending in the longitudinal direction of the hollow body but which differs from the external shape of the human body. In this case, the hollow body is designed elastically at least in one region for propulsion movement, and merges in its rear region into at least one propulsion fin.

40 Claims, 4 Drawing Sheets

DIVING APPARATUS AND METHOD FOR ITS PRODUCTION

BACKGROUND OF THE INVENTION

1. Field of the Invention

The invention relates to a diving apparatus and to a method for its production.

2. Description of the Background Art

In general, divers use diving suits and fins for propulsion in the water. One disadvantage is that the diving suit is generally manufactured only from a relatively thin, synthetic material which closely follows the human body in order to offer as little water drag as possible. Consequently, the human body surrounded by the synthetic skin is subjected virtually directly to external influences underwater, such as cold or attacks by fauna.

Furthermore, in the case of conventional diving suits, an oxygen cylinder also has to be carried, in order to make it possible to remain underwater for a lengthy time. Since this oxygen cylinder is generally of a relatively cumbersome design and has to be carried on the diver's back, it results in additional drag in the water, which makes it necessary to use more force for propulsion in the water.

Furthermore, in this type of diving, it is scarcely feasible to remain underwater for a lengthy time, for example for several days, since it is extremely tedious and tiring to carry items essential for life, such as oxygen or drinking water.

The object of the invention is to make available a diving apparatus which allows a diver to stay in the water for a lengthy time and provides him with better protection against environmental influences. Furthermore, it is intended to specify a suitable method for producing such a diving apparatus.

SUMMARY OF THE INVENTION

A diving apparatus according to the invention is distinguished by the fact that it comprises an elongated hollow body which can completely accommodate a human body extending in the longitudinal direction of the hollow body but which differs from the external shape of said human body, the hollow body being designed elastically at least in one region for propulsion movement, and merging into at least one propulsion fin.

The elongated hollow body, which completely surrounds the human body, effectively protects the latter against external influences, such as the temperature or attacks by fauna living in the water, since the hollow body is well insulated and essentially has a stable shape. In this case, the human body is located entirely within the hollow body and touches the inner surface of the hollow body only in some places. At the same time, the elongated structure of the hollow body, which differs from the human shape, reduces the water drag of the diving apparatus, allowing propulsion through the water with less force.

In the case of the diving apparatus according to the invention, the human body extends in the longitudinal direction of the hollow body, the diver's back preferably pointing upwards towards the water surface and his head pointing forwards in the direction of movement of the diving apparatus when the latter is horizontal in the water in the operating state in order to make it easy to observe objects in front of, below or alongside the diving apparatus, for example the seabed. On the other hand, the human body could alternatively lie such that the diver is viewing the surface of the water when the diving apparatus is in the operating state, so as to make it easy to observe objects above or alongside the diving apparatus, for example in order to carry out a visual examination for damage to ship hulls while in the water.

Furthermore, at least one region is designed elastically or flexibly for propulsion movement, the elongated hollow body merging a one end into a propulsion fin in order to allow effective movement, economical in terms of force, for propulsion purposes, while the hollow body always essentially retains a stable shape. In this case, the hollow body may be flexible or elastic from the nose or cupola end, in particular in the region for propulsion production in the middle and at the rear.

Owing to the elasticity of the hollow body in at least one propulsion region, it is possible to convert, for example, dolphin-like, rhythmic body movements about the body's transverse axis into a flapping movement of the propulsion fin for propulsion purposes. At the same time, the hollow body may be designed to be less elastic outside the region intended for propulsion movement. Thus, for example, the region for propulsion movement could be approximately in the middle of the hollow body so that rhythmic movements of the upper region of the human body result in the flapping movements of the propulsion fin, providing effective propulsion for the diving apparatus.

On the other hand, the region for propulsion movement could alternatively be in the rear part of the hollow body, so that the flapping movement of the propulsion fin can be produced by moving, for example, the region below the hip of the human body. The hollow body could, of course, also be designed completely elastically.

The elastic region or regions for propulsion movement also make it easy to control the diving apparatus according to the invention, and more precisely by the person who is surrounded by the elongated hollow body twisting his body in a suitable manner. Such twisting of the body is carried to the outside by the elastic region and results in the desired direction changes by changing the external geometry of the hollow body.

According to a further refinement of the invention, the hollow body is designed integrally and can be opened for entry purposes. An integrally designed hollow body has, in particular, the advantage that the probability of a leak point being formed during production is less than in the case of a hollow body which is assembled from a plurality of parts, since there are fewer seams and joints.

However, a hollow body which is formed from a plurality of parts is also advantageous since, in the case of such a hollow body, individual elements may be replaced if they are damaged.

The opening for entry purposes in the case of the integrally designed hollow body could be provided, for example, by a zip fastener or Velcro fastener, in which case it is necessary to ensure that this entry opening can be sealed again in a watertight manner. Furthermore, the opening may be constructed anywhere on the hollow body, provided it is possible for the person to enter and exit.

A hollow body which can be split can be likewise entered and exited from more easily, since it can easily be separated for entry purposes and assembled again after entry.

In a further refinement of the invention, a front, transparent region of the hollow body is designed as a cupola so that a person surrounded by the hollow body can look out of it.

A transparent cupola in the front region of the hollow body offers the advantage that the field of view of the person surrounded by the hollow body is enlarged if the cupola is designed in such a manner that the head is largely free to move forwards and to the side.

In this case, the cupola may be fitted on the remaining region of the hollow body. This has the advantage that, in the event of damage to the cupola, it can easily be replaced. However, it is also possible for the transparent cupola to be an integral continuation of the rest of the hollow body, so that it does not need to be transported separately.

It is possible to open the remaining region of the hollow body in the longitudinal direction of the hollow body in order to allow easy entry. To this end, the remaining region of the hollow body could, for example, be provided with a zip fastener which can be opened from the inside or the outside, but which must prevent water from entering the hollow area.

In this case, the remaining region may comprise, for example, at least two shells which can be connected to one another and are connected to one another by means of a hinge so that when the shells are separated or connected this allows entry and exit in a simple manner.

According to yet another development of the invention, the at least one propulsion fin can be connected via a connecting device to he feet and/or to the calves of the human body. This provides effective conversion of foot and/or leg movements into flapping movements of the propulsion fin.

At the same time, the at least one propulsion fin may be horizontal in the operating state, the operating state being defined by the state in which the hollow body is horizontal in the water. The attachment and transmission of muscle power from the person to the integrated, horizontally fitted propulsion fin are effected from both legs, for example by collar-like straps on both lower limbs and feet. The horizontal propulsion fin has the advantage that the diving apparatus according to the invention allows operations to be carried out, for example, very close to the bottom of the waterway, provided the propulsion fin carries out only very small flapping movements. Alternatively, the propulsion fin may be connected just to the feet.

According to another refinement of the invention, the at least one propulsion fin is vertical in the operating state, which has the advantage that the diving apparatus can be used to dive along and very close to steep cliffs, provided the vertical propulsion fin is deflected only slightly to the side by propulsion movements. To this end, the blade of the fin must be integrated in the hollow area at right angles to the body's transverse axis.

The vertical propulsion fin may be connected to two lever-like cantilever beams and preferably extends between the legs of the human body, so that is easy to produce the lateral flapping of the fin by mutual longitudinal displacement of the legs along the longitudinal axis of the body. In this case, shoes to accommodate the feet are attached to both cantilever beams.

The hollow body is preferably designed to be streamlined, in order to offer as little drag in the water as possible. It therefore has a shape to assist flow and, in consequence, produces little drag.

According to a development of the invention, the hollow body is designed in the shape of a fish, as a result of which it is possible, for example, to stay in schools of fish without being noticed. At the same time, other hollow body shapes which are similar to the animal world are feasible.

In another development of the invention, the hollow body has external features which are characteristic of specific fish groups in order to improve the camouflage of the diving apparatus further. Such characteristic features could be, for example, a dorsal fin, artificial gill flaps or the like.

In order to improve the camouflage further, the hollow body could also be provided with a colouring on the basis of a biological pattern.

According to a preferred refinement of the invention, the hollow body is composed of rubber and/or plastic, which makes if possible to manufacture the hollow body easily. Other materials which are not cited in the description but which are likewise suitable for the hollow body are conceivable.

According to another refinement of the invention, the hollow body is composed of at least one outer water-repellent layer and one inner supporting layer, which supports the outer layer. The outer water-repellent layer prevents water from entering the hollow body. The inner supporting layer at all times provides the overall hollow body with a shape which is essentially robust and is convex in most regions.

According to a further refinement of the invention, the supporting layer may be composed of a material which absorbs water and/or gas. The supporting characteristic of the supporting layer must be maintained in this case. In this way, air for breathing or propulsion purposes, for example, may be absorbed or held by the supporting layer.

In this arrangement, the inside of the supporting layer may also be covered with a watertight or gas-tight material in order to prevent the ingress of materials stored in the supporting layer, for example water, into the internal area of the hollow body.

The supporting layer may furthermore be divided into a plurality of chambers which are separated from one another in a watertight and/or gas-tight manner. This makes it possible to accommodate different materials in the supporting layer, without them being mixed with another.

According to a preferred embodiment of the invention, the wall of the hollow body has hollow chambers which can also be connected to one another by channels, for example via flexible tubes.

In this arrangement, the hollow chambers may be filled with a liquid or with gas so that, for example, drinking water or oxygen may be carried in order to allow longer dives. At the same time, it is also possible to fill the hollow chambers with solid material. A flexible tube system may also be combined with the hollow chambers in order to allow for the diving apparatus to be balanced by filling and emptying the hollow chambers. A corresponding statement also applies to chambers which are composed of material which absorbs water or gas. In the case of the hollow chambers, they and the flexible tube system may be formed by surrounding previously introduced containers and flexible tubes with foam.

According to another development of the invention, the chambers and/or hollow chambers can be filled or emptied by means of a manually operated pump system. In this case, the manually operated pump system could be formed, for example, by means of bellows which are connected to the chambers via flexible tubes and which when operated, for example by the diver moving his arms or hands, can pump air or water into or out of the chambers and/or hollow chambers. Using such a pump system, it is easy for the divine apparatus to be balanced without using electrical energy, that is to say for the diving apparatus to be balanced without using external energy, just by the diver's muscle power.

However, the pump system could also be electrically operated, in which case it will be necessary to provide an electrical power supply, for example a battery, in one of the chambers. Alternatively, the pump system could also be pneumatically operated; in this case, an energy supply, for example in the form of compressed air, would then have to be carried in pressurized cylinders.

According to another refinement of the invention, at least one of the chambers is connected to the interior of the hollow body and to an air inlet tube which points upwards when the diving apparatus is in the operating state. In this way, it is possible to suck in air via the air inlet tube by means of the pump system, and to store the air in at least one of the chambers. The air inlet tube expediently points upwards so that, when the diving apparatus is on the surface, it is possible to suck in air from the atmosphere. This air could then be stored in at least one of the chambers in order to admit it into the interior of the hollow body when required, for example likewise by means of the pump system, for breathing. In order to exchange the breathing air in the hollow body regularly, the diver may therefore come to the water surface in order to pump out the used air by means of the pump system, for example the bellows, and to suck new air into the hollow body via the air induction tube.

The air inlet tube could, for example, be integrated directly on the outer surface of the hollow body or could, for example, be in a dorsal fin, only the latter having to project out of the water in order to suck air into at least one of the chambers and to emit it when required into the interior of the hollow body.

According to a further refinement of the invention, some of the hollow chambers are open towards the inside or outside of the hollow body. A chamber which is open towards the inside of the hollow body could be used, for example, to accommodate an oxygen cylinder carried in the hollow body, in order to ensure an oxygen supply in a conventional manner.

According to another development of the invention, the hollow body has openings for the arms of the human body to pass through, open chambers being constructed on the outside in order to accommodate the arms. In this way, the arms of a person surrounded by the hollow body can on the one hand be accommodated safely and can on the other hand be spread out laterally for control purposes.

Furthermore, the openings can be connected to closed sleeves for accommodating the arms, so that it is possible to carry out simple tasks outside the hollow body. However, the openings could also be designed in such a manner that the arms can be spread outwards only when required so that, in general, they are in the interior of the hollow body in order, for example, to carry out tasks in the interior of the hollow body. The option to spread the arms out laterally and to pull them in again allows a pump system which is operated by muscle power and is located, for example, in the shoulder region, or a steering system, to be implemented in a simple manner.

The design of the openings for the hollow chambers (which are open to the outside) for the arms could be in the form of a lip. These lips touch one another along the outer longitudinal axis of the hollow chamber, so that the arms can be pushed out through the existing slot at any time, and can be moved freely. The lips (which rest on one another) of the hollow chamber, which is in principle open as a result of the existing gap, for accommodating the arms allow the flow losses produced by vortices to be kept low.

According to one embodiment of the invention, the hollow body has a body supporting device which is located in the interior and is matched to the shape of the human body, by means of which it is possible to lie in the interior of the hollow area for a long time while saving power. The supporting structure could furthermore be designed in such a way that it also protects the human body against cold, for example. The supporting structure gives the human body in the interior of the hollow area more security and can thus more effectively convert the body movements into a flapping movement of the propulsion fin.

According to a further refinement of the invention, a snorkel is arranged in the front region of the hollow body. This snorkel could, for example, be located on the top of the cupola and, when the diving apparatus is in the operating state, would point upwards towards the water surface. In this way, it is possible when diving close to the water surface to suck in air from the atmosphere for breathing purposes, via the snorkel. Alternatively, the snorkel could be integrated in a dorsal fin. In this case, air may be sucked in with the aid of the pump system or by the diver's breathing process. In this arrangement, a valve should expediently be incorporated between the snorkel and cupola to make it impossible for water to enter the cupola via the snorkel when diving more deeply. The valve could be manually operated, or else could be automatic.

In a further embodiment of the invention, the cupola is designed in such a manner that indicating instruments, such as a speedometer or a depth gauge, are integrated so that the dive can easily be monitored at any time in a simple manner.

A method according to the invention for producing a diving apparatus composed of an elongated hollow body which can accommodate a human body extending in the longitudinal direction of the hollow body is distinguished by the following steps:

formation of a negative mould of at least parts of the hollow body;

lining of the negative mould with a watertight first layer; and fitting at least one insulation layer onto the inside of the first layer which is located in the negative mould.

One advantage of the method for producing a diving apparatus according to the invention is the small number of method steps, which has a positive effect on the production costs.

The negative mould may be formed, for example, from a number of shells. This allows the external shape of the diving apparatus to be produced in a simple manner.

On the basis of a development of the method according to the invention, the first layer is drawn against the negative mould by vacuum pressure, as a result of which the subsequent outer skin rests in a form-fitting manner against the negative shell and is composed, for example, of flexible rubber material which is resistant to and waterproof against sea water. In this case, the outer skin may be composed of any other material suitable for this purpose, even if this is not explicitly cited in the description.

Furthermore, according to the invention, the at least one insulation layer may be formed by foam expansion of material. The foam material is in this case preferably flexible and may be suitable for holding liquids or gas, providing it is appropriately porous. Thus, after curing, this results in the diving apparatus having an external shape which can be bonded very well to an outer skin and is convex but is nevertheless still flexible.

With the aid of this at least one insulation layer, it is possible for the human body to remain in the hollow body for very long periods without becoming hypothermic.

Instead of just one insulation layer on the inside of the outer skin, a plurality of insulation layers would also be conceivable, and this would further improve the thermal insulation property of the diving apparatus.

According to another development of the method according to the invention, a region between a positive mould and the negative mould is filled with foam in order to form the insulation layer. The positive mould may, for example, be similar to the shape of the human body, which makes individual matching to the respective diver possible. It may also be provided with water-resistant watertight insulation, which remains on the foam material after removal of the positive mould.

According to a further refinment of the method according to the invention, the hollow chambers and channels are introduced into the insulation layer by surrounding appropriate containers and pipes, which have previously been installed, with foam. In this way, it is possible to fit and/or to assemble and to connect all the connections in advance. The sealing nature of the foam expansion irreversibly bonds all the surfaces to one another, as a result of which the containers and pipes are integrated in the wall of the hollow body in a simple manner. This ensures a manufacturing process which is simple but nevertheless reliable.

On the basis of yet another refinement of the method according to the invention for forming the insulation layer, material which absorbs water and/or gas is used, so that the insulation layer can itself form at least one chamber. Alternatively, a plurality of chambers may be formed in this way, which are separated from one another by material which is impermeable to water and/or gas.

Finally, according to the invention, different wall elements may be produced and then assembled to form the hollow body. This has the advantage that the various wall elements may be manufactured easily from different materials.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Exemplary embodiments of the invention are described in more detail in the following text with reference to the attached drawing, in which.

DETAILED DESCRIPTION OF THE PREFERRED EMBODIMENTS

Figure 1:
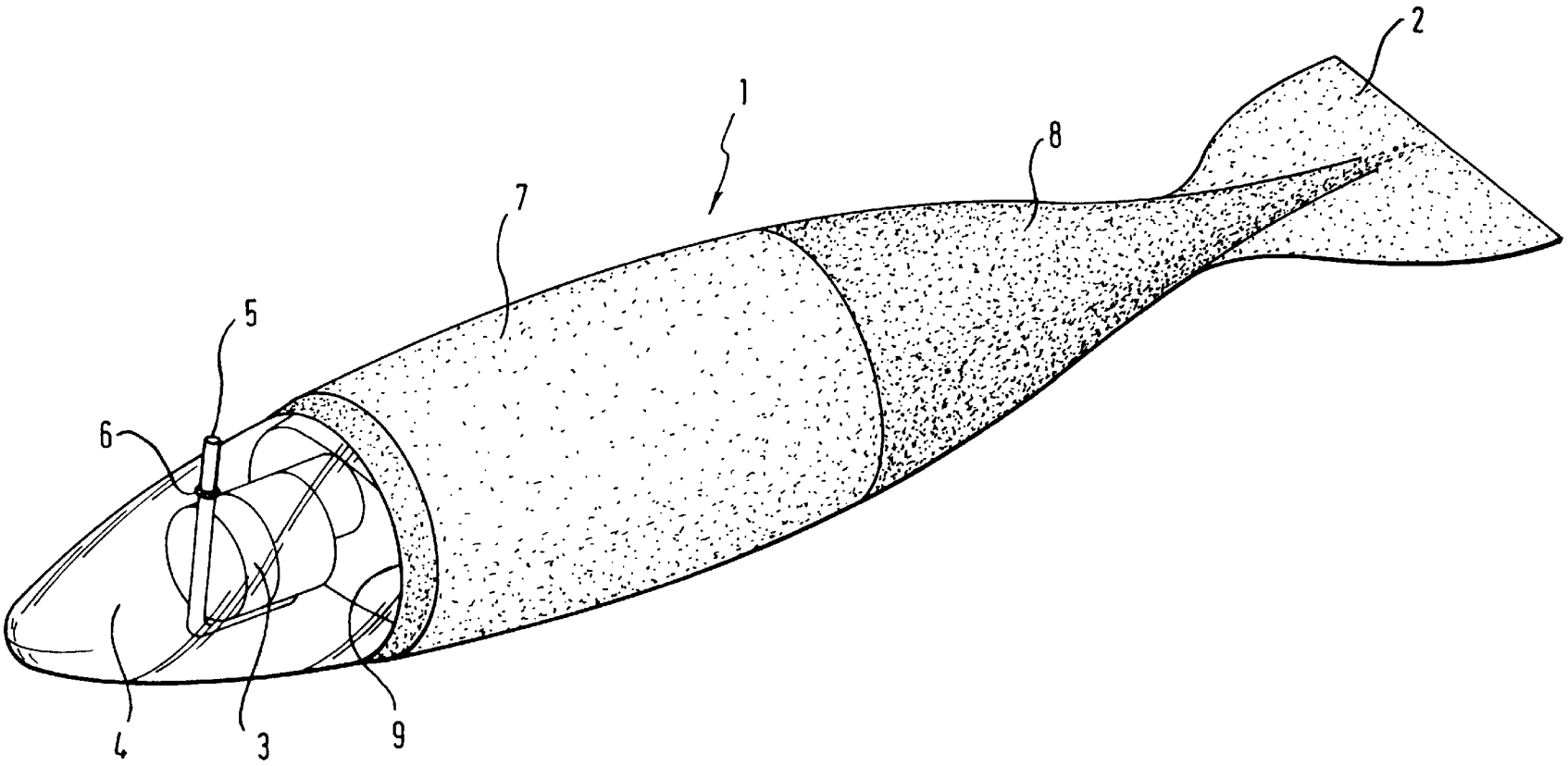
FIG. 1 shows an overall view of a first exemplary embodiment of a diving apparatus according to the invention.

FIG. 1 shows a shaded overall view of a first preferred exemplary embodiment of a diving apparatus according to the invention, composed of an elongated hollow body 1 and a horizontal propulsion fin 2 which is integrally connected to the hollow body 1.

FIG. 1 further shows a head 3 of a human body which is lying in the longitudinal direction of the hollow body and projects into a transparent cupola 4.

As can be seen in FIG. 1, the cupola 4 also has a snorkel 5 which points upwards and projects into the cupola 4 through a seal 6. As can also be seen, the cupola 4 offers sufficient space for the head 3 to be turned easily to the front and to the side.

Furthermore, the preferred, first exemplary embodiment of the invention has a region 7 located approximately in the middle as well as a region for propulsion movement in the rear part 8 of the hollow body 1. As shown in FIG. 1, the middle region 7 is designed to be less elastic than the rear part 8 of the hollow body 1. Furthermore, an insulation layer 9 can be seen, in which the torso of the person lying in the hollow body 1 is embedded.

Figure 2:
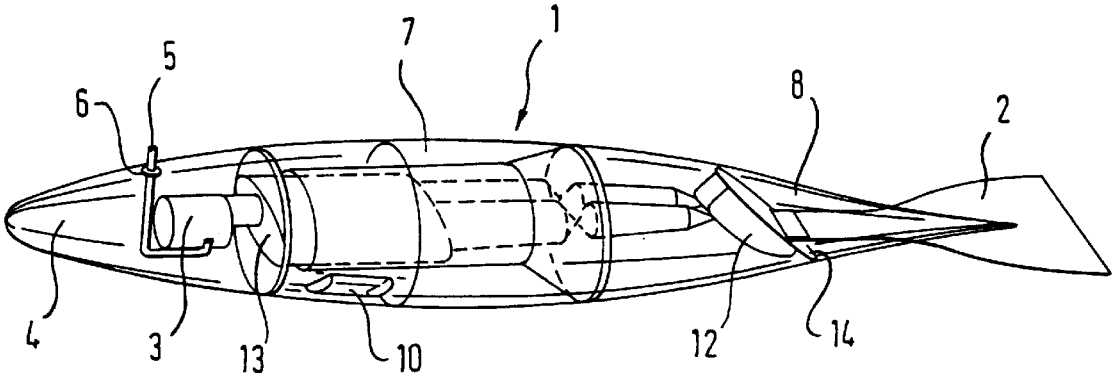
FIG. 2 shows an overall view of the first exemplary embodiment according to FIG. 1, as an outline model.

FIG. 2 shows an overall view of the first exemplary embodiment according to FIG. 1, as an outline model. In this figure, the same reference numbers are used for the same parts as in FIG. 1.

Figure 3:
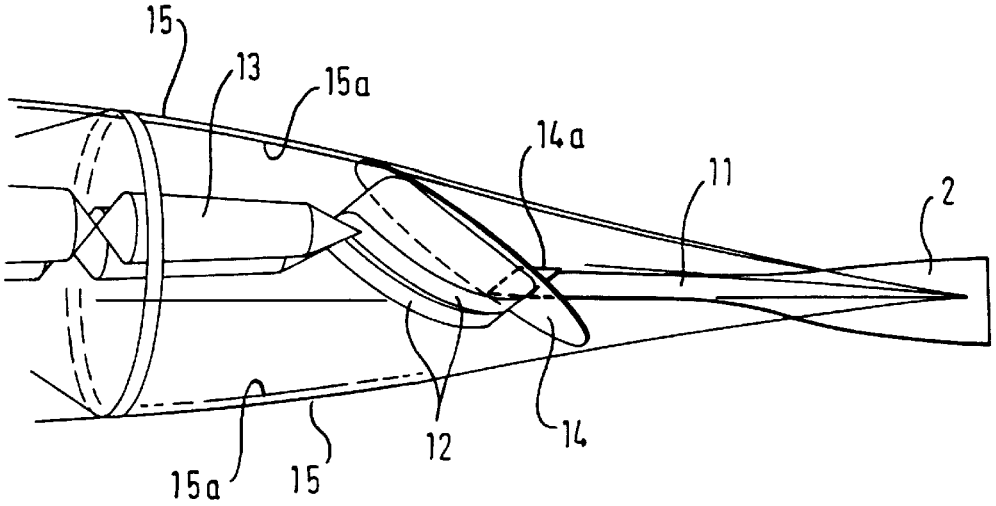
FIG. 3 shows a detailed drawing of the rear region of the exemplary embodiment according to FIG. 2.

As can be seen in FIG. 2, in the preferred, first exemplary embodiment of the invention, there are hollow chambers 10 in the wall of the hollow body 1, to accommodate liquid, gaseous or solid materials. A connecting unit 11, shown in FIG. 3, is furthermore formed in the rear part 8 of the hollow body 1, via which the feet of the human body 13 are connected to the propulsion fin 2. As can also be seen in FIG. 2, the rear part 8 of the hollow body 1 extends roughly as far as the hip of the human body 13.

FIG. 3 shows a detailed drawing of the rear part 8 of the first exemplary embodiment according to FIG. 2. Once again, the same reference numbers have likewise been chosen for the same components.

As can be seen in FIG. 3, in the case of the preferred, first exemplary embodiment of the invention, the feet are fixed by shoes 12 on a plate 14 which is coupled via the connecting unit 11 to the propulsion fin 2. The connecting unit 11 is composed of a relatively stiff horizontal plate of elongated design which, for example, projects integrally from the propulsion fin 2 and points in the direction of the human body 13. The free end of this horizontal plate in the direction of the human body 13 is mounted obliquely on the plate 14, for example via an angled element 14*a* of suitable design. In this case, the plate 14 is located obliquely with respect to the longitudinal direction of the hollow body 1 and is fitted, on its side opposite the connecting unit 11, with shoes 12, which are firmly connected to it, for holding the feet of the human body 13. The overall connecting unit 11 is located in the interior of the hollow body 1, so that only the propulsion fin 2 projects from the latter. In this case, the rear end of the hollow body 1 runs to a tip in the direction of the propulsion fin 2 and is, for example, welded or bonded to the latter there.

In the present case, the rear end of the hollow body 1 is designed to be more elastic in order to allow the legs of the human body 13 to carry out flapping movements. The middle part of the hollow body could then be less elastic and be used essentially for shape stabilization. On the other hand, however, it is also possible for the entire region of the hollow body 1 located outside the cupola to be designed to be more elastic but still to have form stability in order to permit dolphin-like movements of the human body 13 as well, such movements essentially being produced as a result of the fact that said human body 13 can also be bent in the hip region.

FIG. 3 furthermore shows a watertight first layer 15 which encloses the entire hollow body 1, there being a supporting layer 15*a*, which is designed as an insulation layer, under the first layer 15.

Figure 4:
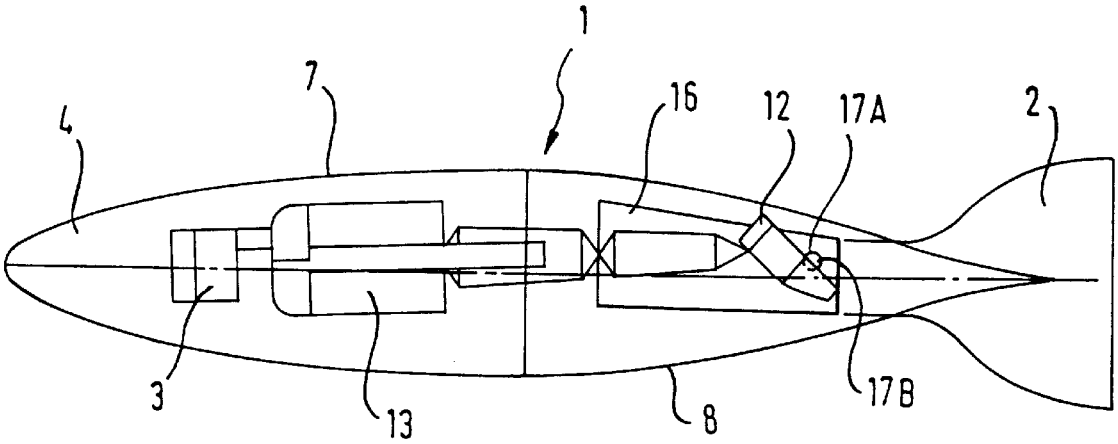
FIG. 4 shows a side view of a longitudinal section of a second exemplary embodiment according to the invention.

FIG. 4 shows a side view of a second preferred exemplary embodiment of the invention as an outline model, the same reference numbers as in FIGS. 1 to 3 being chosen for identical parts.

As can be seen in FIG. 4, the second preferred exemplary embodiment differs from the first in that the propulsion fin 2 is arranged vertically in the operating state. A continuation 16 of the propulsion fin 2 in the form of a plate extends as far as the knee region of the human body 13, and thus projects into the interior of the rear part 8 of the hollow body 1.

In order to drive the propulsion fin 2, two lever-like cantilever beams 17A, 17B are attached to opposite sides of the continuation 16, via which cantilever beams 17A, 17B the feet of the human body 13 are connected to the propulsion fin 2 for propulsion movement. In this case, the feet are inserted in shoes 12 which are attached to the cantilever beams 17A, 17B.

Figure 5:
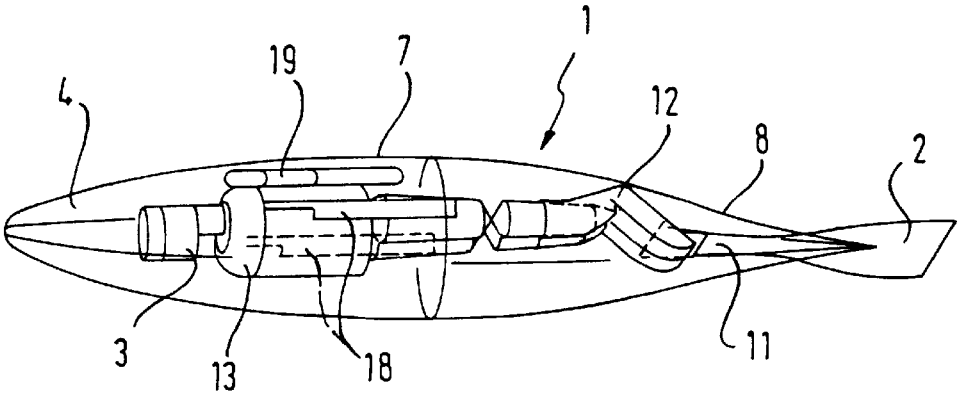
FIG. 5 shows a perspective view of a third exemplary embodiment of the invention.

FIG. 5 shows an overall view of a third preferred exemplary embodiment of the invention. The same reference numbers as in the preceding figures are used for identical parts.

FIG. 5 differs from FIG. 1 essentially in that there is no longer a snorkel 5 in the cupola 4 and in that, instead of this, there is an oxygen apparatus 19 in the region of the back of the human body 13. This oxygen apparatus 19 is located in a hollow area, which is open on the inside, in the hollow body 1, the hollow area being located in the wall of the hollow body 1. In this case, the oxygen apparatus 19 is connected to a breathing mask worn by the diver.

In the exemplary embodiment according to FIG. 5, the shoes 12 are furthermore replaced by rigid-sided boots, so that even more power can be transmitted to the propulsion fin 2.

Figure 6:
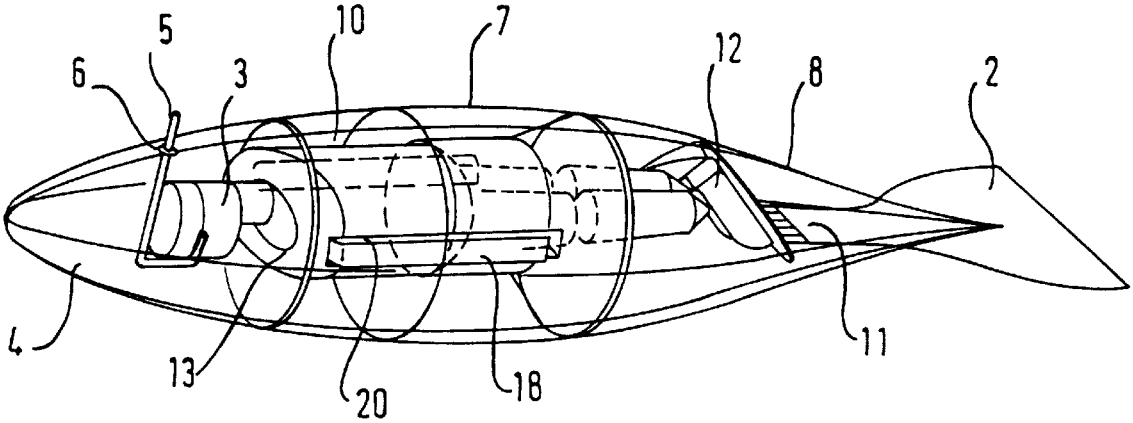
FIG. 6 shows an overall view of a fourth exemplary embodiment according to the invention.
Figure 7:
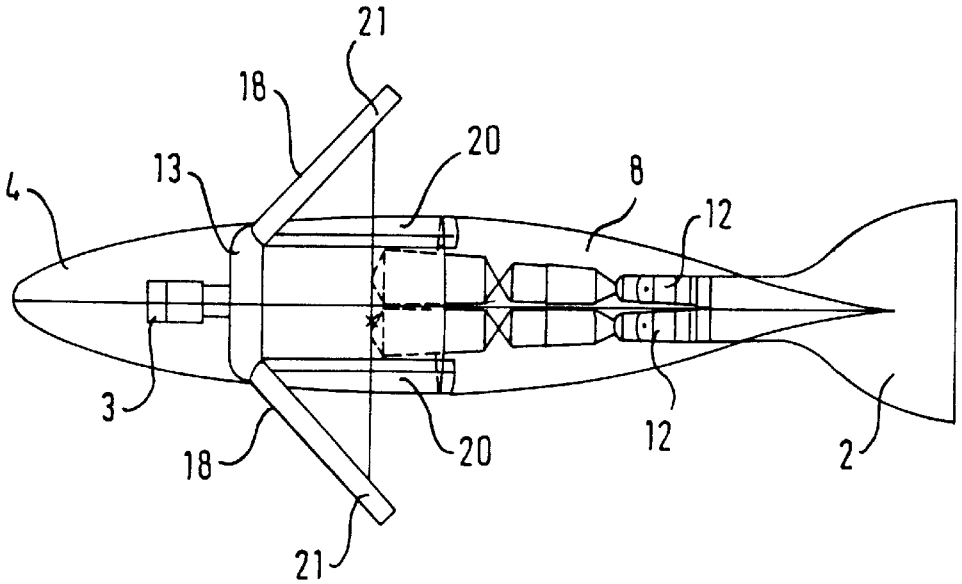
FIG. 7 shows a plan view of the fourth exemplary embodiment according to FIG. 6.

FIGS. 6 and 7 relate to a fourth exemplary embodiment of the invention. Once again, the same reference numerals as in the preceding figures are used for identical components.

In the case of the fourth exemplary embodiment according to FIGS. 6 and 7, hollow chambers 20 which are open on the outside are located in the side wall of the hollow body 1. These hollow chambers 20 extend in the longitudinal direction of the hollow body 1 and are used to accommodate the arms 18 of the human body 13, these arms being passed to the outside through the wall of the hollow body 1. To this end, the wall of the hollow body 1 is provided with corresponding passage openings, which can be connected to sleeves, and then to gloves, into which the arms 18 of the human body 13 project in order to prevent water from entering the interior of the hollow body 1 when the arms 18 are outside the hollow body 1.

The arms 18 are spread away from the hollow body 1 when the diver considers this to be necessary to assist the longitudinal movement of his diving body or when, for example, he wishes to pick up objects from the seabed. During motion of the hollow body 1, he can put his arms 18 into the hollow areas 20 on the outside, in order to reduce the flow drag.

The wall thickness of the hollow body 1 in the region of the hollow chambers 20 does not necessarily need to be exactly as thick as the width and/or thickness of the hollow chambers 6. It is also possible for the hollow chambers 20 to be formed as convex shapes in the hollow body 1. In each case, there is also a water-repellent layer on the outside in the interior of the hollow chambers 20.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A diving apparatus comprising:

an elongated hollow body which can completely accommodate a human body therein extending in a longitudinal direction of the hollow body, said hollow body having an extended shape which differs from an external shape of said human body, said hollow body having at least one elastic region for propulsion movement, and at least one propulsion fin, wherein the at least one propulsion fin can be connected via a connecting device to the feet and/or to the calves of the human body.

2. The diving apparatus according to claim 1, wherein the hollow body is less elastic outside the elastic region for propulsion movement.

3. The diving apparatus according to claim 2, wherein the elastic region for propulsion movement is located approximately in the middle of the hollow body.

4. The diving apparatus according to claim 2, wherein the elastic region for propulsion movement is located in a rear part of the hollow body.

5. The diving apparatus according to claim 1, wherein the hollow body is an integral unit which can be opened for entry purposes.

6. The diving apparatus according to claim 1, wherein the hollow body can be split.

7. The diving apparatus according to claim 1, wherein a front region of the hollow body includes a transparent cupola.

8. The diving apparatus according to claim 7, wherein the cupola is fitted on a remaining region of the hollow body other than said elastic region.

9. The diving apparatus according to claim 8, wherein the remaining region of the hollow body is openable in the longitudinal direction of the hollow body.

10. The diving apparatus according to claim 9, wherein the remaining region comprises at least two shells which are connectable to one another.

11. The diving apparatus according to claim 10, wherein the shells are connected to one another by a hinge.

12. The diving apparatus according to claim 7, further comprising indicating instruments arranged in the cupola.

13. The diving apparatus according to claim 1, wherein the at least one propulsion fin is horizontal in an operating state.

14. The diving apparatus according to claim 1, wherein the at least one propulsion fin is vertical in an operating state.

15. The diving apparatus according to claim 14, wherein the vertical propulsion fin is connected to two cantilever beams and extends between legs of the human body.

16. The diving apparatus according to claim 1, wherein the hollow body has a streamlined external shape.

17. The diving apparatus according to claim 1, wherein the hollow body is composed of an outer water-repellent layer, and an inner supporting layer which supports the outer layer.

18. The diving apparatus according to claim 17, wherein the supporting layer is composed of a material which absorbs water and/or gas.

19. The diving apparatus according to claim 18, wherein the inside of the supporting layer is covered with a watertight and/or gas-tight material.

20. The diving apparatus according to claim 18, wherein the supporting layer is divided into a plurality of chambers which are separated from one another in a watertight and gas-tight manner.

21. The diving apparatus according to claim 1, further comprising hollow chambers in the wall of the hollow body.

22. The diving apparatus according to claim 21, wherein the hollow chambers are connected to one another via channels.

23. The diving apparatus according to claim 21, wherein the hollow chambers can be filled with a liquid or with gas.

24. The diving apparatus according to claim 21, further comprising a pump system for filling or emptying the hollow chambers.

25. The diving apparatus according to claim 24, wherein the pump system can be driven manually and/or by muscle power.

26. The diving apparatus according to claim 25, wherein at least one of the hollow chambers is connected to the interior of the hollow body and to an air inlet tube which points upwards when the diving apparatus is in an operating state.

27. The diving apparatus according to claim 26, further comprising a dorsal fin on said hollow body through which the air inlet tube passes.

28. The diving apparatus according to claim 21, wherein the hollow chambers are open towards the inside or outside of the hollow body.

29. The diving apparatus according to claim 1, wherein the hollow body has openings for the arm of the human body to pass through, and open chambers for accommodating the arms are constructed on the outside of the hollow body.

30. The diving apparatus according to claim 29, wherein the openings are connected to closed sleeves for accommodating the arms.

31. The diving apparatus according to claim 1, further comprising a body supporting device arranged in an interior of the hollow body and matched to the shape of the human body.

32. The diving apparatus according to claim 1, further comprising a snorkel arranged in a front region of the hollow body.

33. A method for producing a diving apparatus composed of an elongated hollow body which can accommodate a human body extending in the longitudinal direction of the hollow body, said method comprising the following steps:

forming a negative mold of at least parts of the hollow body;

lining the negative mold with a watertight first layer; and fitting at least one insulation layer onto the inside of the first layer which is located in the negative mold.

34. The method according to claim 33, further comprising the step of drawing the first layer against the negative mold by vacuum pressure.

35. The method according to claim 33, further comprising the step of forming the at least one insulation layer by foam expansion of material.

36. The method according to claim 35, further comprising the step of filling a region between a positive mold and the negative mold with foam in order to form the insulation layer.

37. The method according to claim 35, further comprising the step of incorporating hollow chambers and channels in the insulation layer.

38. The method according to claim 37, wherein the hollow chambers and channels are incorporated by surrounding appropriate containers and pipes, which have previously been installed, with foam.

39. The method according to claim 33, wherein a material which absorbs water and/or gas is used to form the insulation layer.

40. The method according to claim 33, wherein different wall elements are produced separately and are assembled to form the hollow body.

* * * * *